US005377850A

United States Patent [19]

Liaw

[11] Patent Number: 5,377,850

[45] Date of Patent: Jan. 3, 1995

[54] MODULAR STATIONERY STAND

[76] Inventor: Peter Liaw, No. 25, Lane 60, Alley 164, Fu Lin Street, Taipei, Taiwan, Prov. of China

[21] Appl. No.: 94,809

[22] Filed: Jul. 20, 1993

[51] Int. Cl.[6] ..... A47F 5/00

[52] U.S. Cl. ..... 211/163; 211/11

[58] Field of Search ..... 211/163, 11, 10, 69.1, 211/78, 129, 131

[56] References Cited

U.S. PATENT DOCUMENTS

| | | | |
|---|---|---|---|
| 1,643,477 | 9/1927 | Warren | 211/163 X |
| 3,227,283 | 1/1966 | Ahlman | 211/163 X |
| 4,579,399 | 4/1986 | Poltash | 211/163 X |
| 4,700,829 | 10/1987 | Goodyear | 211/11 X |
| 4,953,696 | 9/1990 | Huang et al. | 211/163 X |

*Primary Examiner*—Alvin C. Chin-Shue
*Assistant Examiner*—Sarah L. Purol
*Attorney, Agent, or Firm*—Pro-Techtor International

[57] ABSTRACT

A modular stationery stand including a rotary base, a lower case with many shell-shaped spaces, an upper case, and a lattice cover. The base has a large cylinder in the center, and smaller cylinders mounted in the four corners. There are corresponding hollow cylinders installed in the upper pen case and the lower case. The lattice cover covers said pen case and has a hole to receive hollow cylinder so as to form a rotating stationery stand with upper and lower layers.

1 Claim, 5 Drawing Sheets

MODULAR STATIONERY STAND

BACKGROUND OF THE INVENTION

The present invention relates to an improved modular stationery stand, and more particularly to a modular stationery stand which has rotating upper and lower layers.

The shape and structure of the prior art stationery stand has few changes in the past. As the quality of life has risen in recent years, however, similar products show a tendency to be (1) versatile (2) easy to assemble and dismantle (3) unique in external appearance (4) more practical so as to meet with the taste of modern people. The inventor, a professional manufacturer of stationery, has been endeavoring for many years to develop improved stationery stand of the present invention for catching up to the aforesaid tendency.

SUMMARY OF THE INVENTION

It is therefore to the main object of the present invention to provide a stationery stand comprising upper and lower layers on which to place objects.

It is another object of the present invention to provide a stationery stand which is easy to assemble, strong and practical.

DETAILED DESCRIPTION OF THE PREFERRED EMBODIMENTS

The modular stationery stand of the present invention comprises a rotary base 1, a lower case 2, an upper case 3 and a cover 4.

Figure 3:
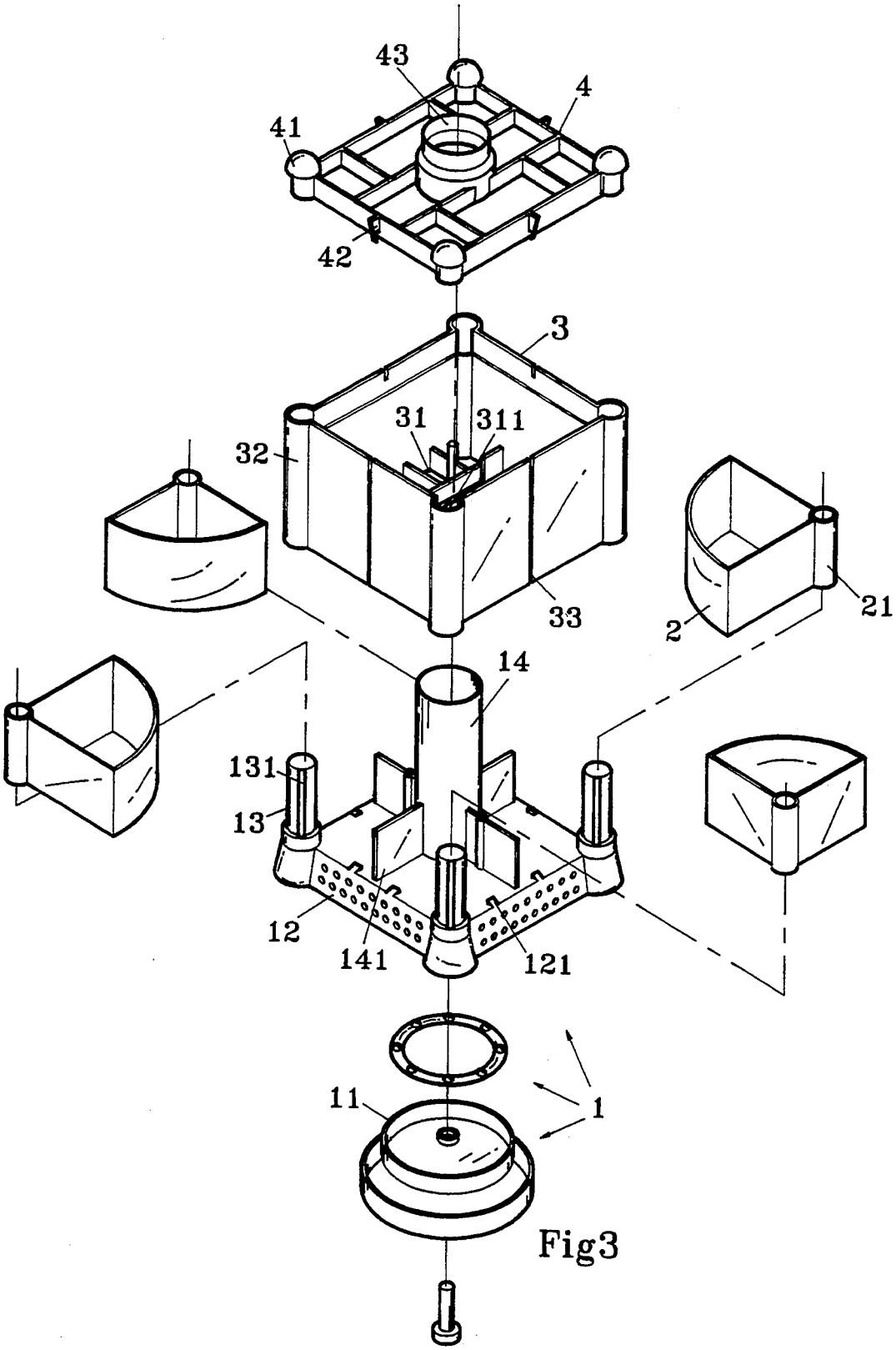
FIG. 3 is an exploded view of the present invention.
Figure 4:
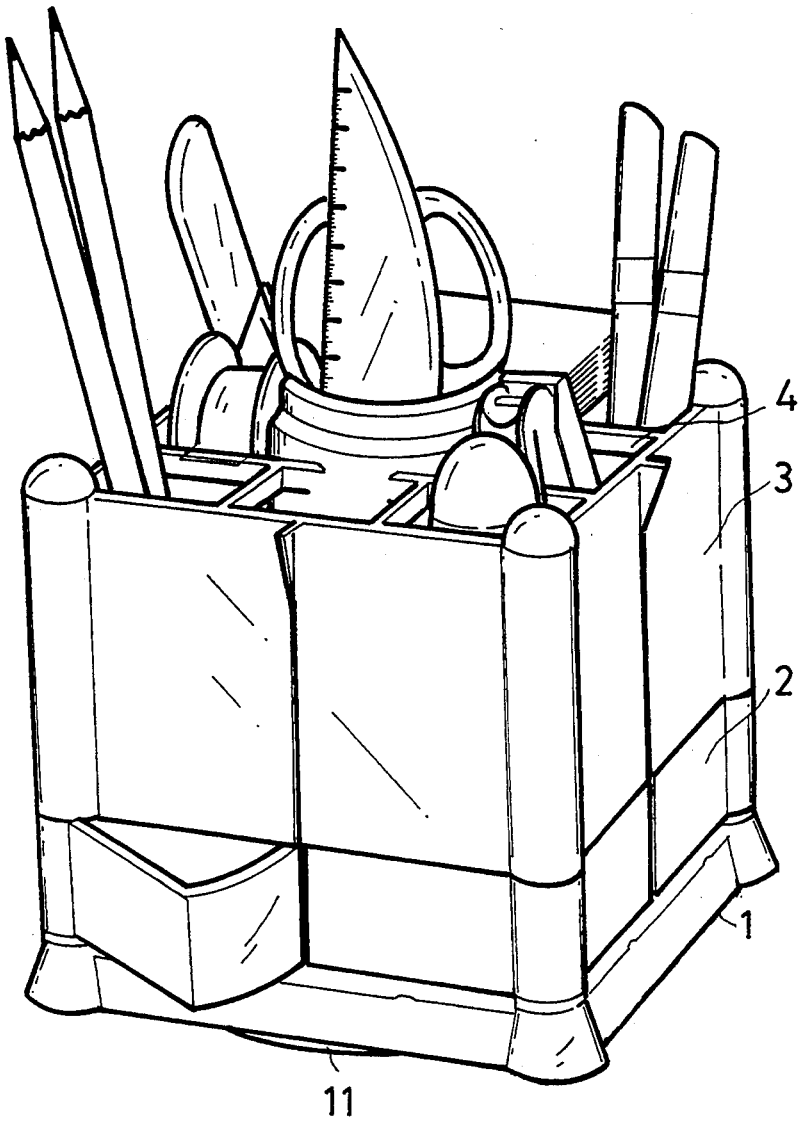
FIG. 4 is an illustration of the present invention in use.

Referring now chiefly to FIG. 3, said rotary base 1 has a trapezoidal section 12 which is rotatably affixed to a round plate 11. Rotation of the trapezoidal section 12 on the round plate 11 is facilitated by ball bearings. Four cylinders 13 are installed in each of the four corners respectively. Said cylinders each have a protrusion 131 to aid in alignment and assembly. Said trapezoidal section 12 has a hollow cylinder 14 extending vertically from its center with four dividing partitions 141 connected to both the base of said cylinder 14 and said trapezoidal section 12 so as to divide the upper surface of said trapezoidal section 12 into four separate spaces. Alignment bumps 121 protrude from the periphery at the upper surface of said trapezoidal section 12.

Said lower case 2 comprises four quarter circle shaped containers, each having a hollow cylinder 21 at its small end which is placed over the cylinders 13 in the four corners of said base 1. The four containers each movably occupy one of the four separate spaces on the upper surface of the trapezoidal section 2. A flange 22 contacts said convex points 121 to limit the rotation of the container.

Said upper case 3 is a rectangular case which has an aperture 311 to receive said hollow cylinder 14 in a base 31 of the case 3. The case 3 includes multiple separating plates in different height and shapes installed in its interior. Four hollow cylinders 32 in each of the cases four corners receive the top ends of said cylinders 13 in said base 1. Outside the case there are grooves 33 in the four sides.

Said cover 4 is a lattice frame wherein hemispheric caps 41 are installed in the four rounded corners of the cover 4. The rounded corners are received in the hollow cylinders 32 of said upper case 3. There are triangular protrusions 42 installed in the four sides of the cover 4 which slide into the openings 331 of the upper case 3. Said cover 4 has a hole 43 in the center to receive the hollow cylinder of said rotary base 1.

The stationery stand has an attractive external appearance and multiple layers for storing objects. Said lattice cover 4 has to be covered on the upper pen case so as to form separate spaces for putting pens, rules, scissors and so on. Said separate plates in different height form places where adhesive tapes, glue and highlighters may be stored. Small items like thumb tacks, glue and pens can be put in the lower case.

The characteristics of the present invention are as follows:

1. When lattice cover 4 connects with said upper pen case 3, separate spaces are formed to store stationery items orderly and easily.

2. Said lattice cover 4 connects with the upper pen case 3 by said triangle convex pieces 42 and rounded corners which not only beautify the external appearance but fix said lattice cover securely.

3. The upper layer is designed for placing standing and large writing tools and the lower layer is designed for placing little things. Such construction meets the needs of practicality and versatility.

Figure 1:
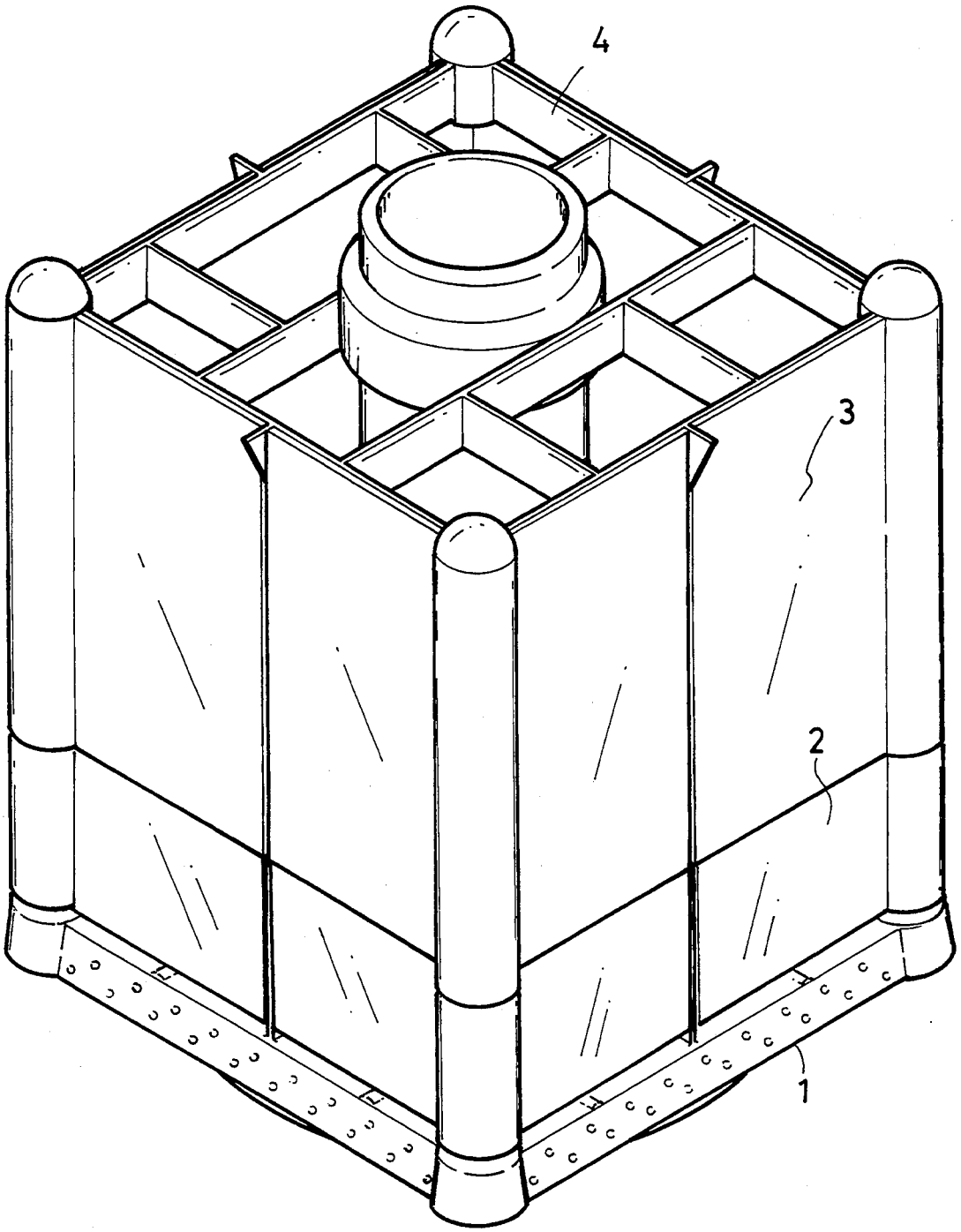
FIG. 1 is a three-dimensional view of the present invention.
Figure 2:
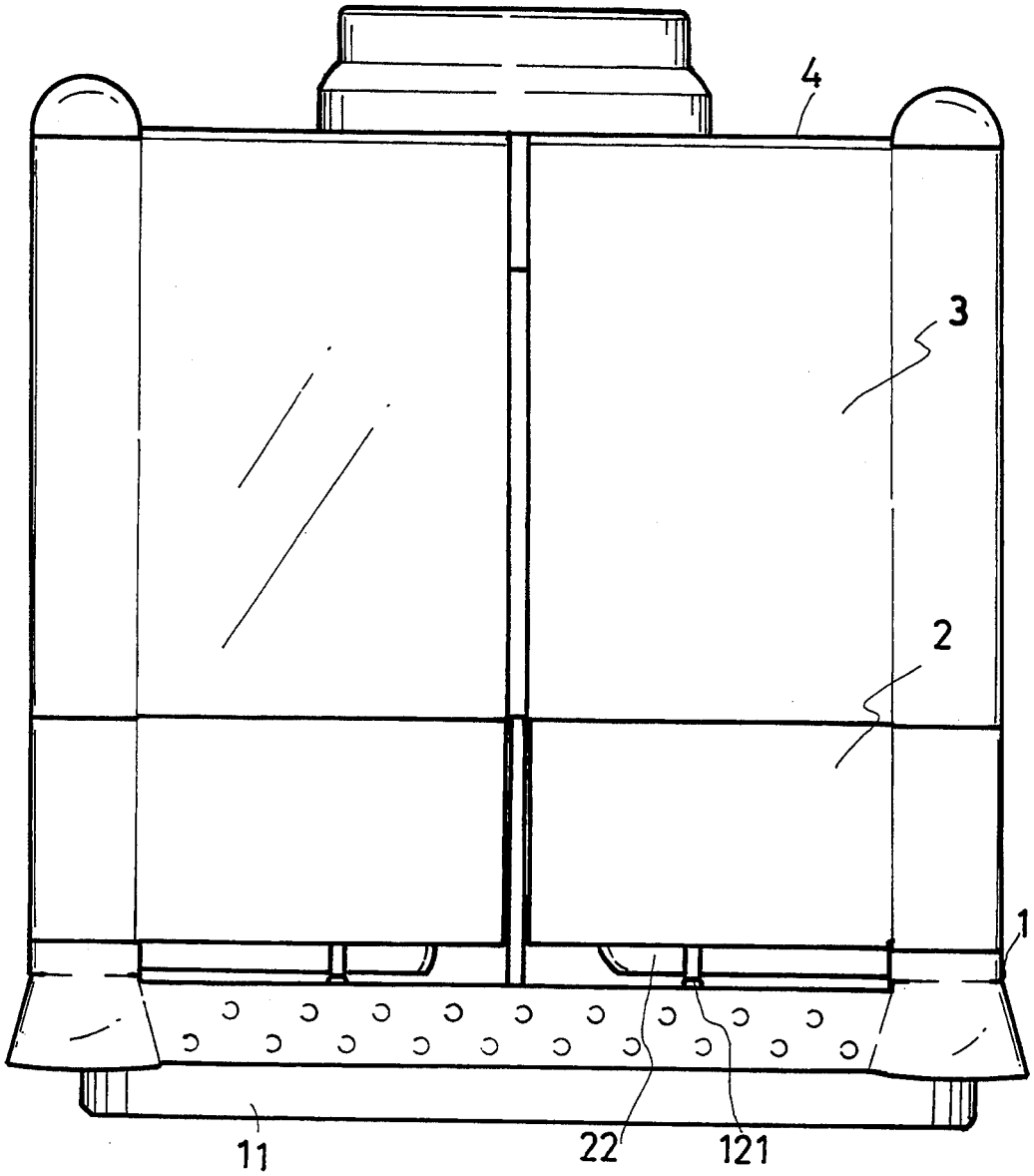
FIG. 2 is a profile of the present invention.
Figure 5:
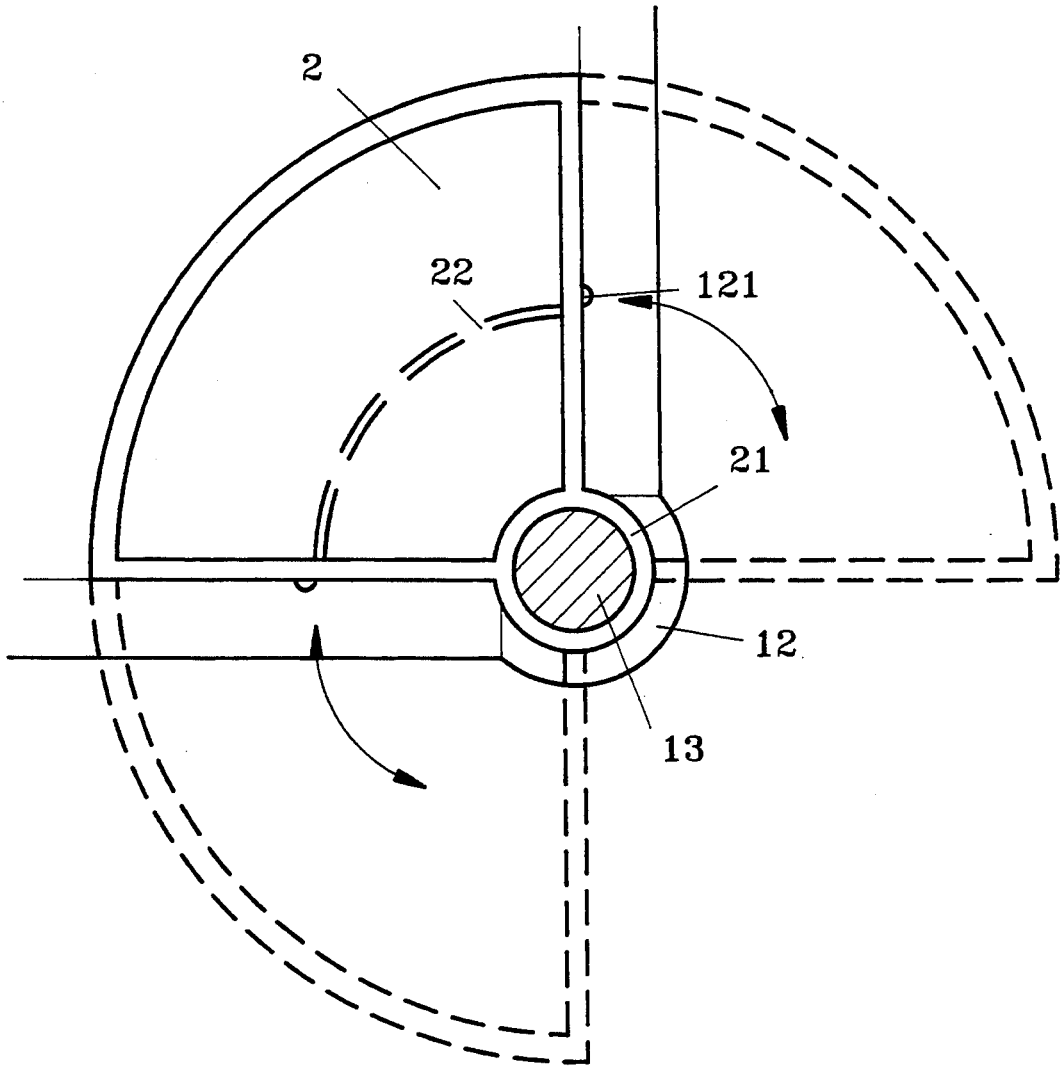
FIG. 5 is an illustration of the operation of the lower layer of the present invention.

4. Referring to FIGS. 2 and 5, the design of said plate-shaped flange 22 in the bottom of the lower case 2 and said convex point 121 in one side of the corresponding rotary base 1 can limit the rotary angle of the shell-shaped container so as to keep the stability of the lower case 2.

While only a few embodiments of the present invention have been shown and described, it will be understood that various modifications and changes could be made without departing from the spirit and scope of the invention.

What is claimed is:

1. A modular stationery stand comprising: a rotary base, a lower case with multiple separate spaces, an upper case and a lattice cover;

said rotary base includes a trapezoidal section rotatably affixed to a steel plate, said base further includes cylinders with a projection mounted in each of the four corners, a large hollow cylinder is installed in the center of said trapezoidal section, and protuberant pieces connect both a lower end of said large hollow cylinder and with said trapezoidal section to form separate spaces;

said lower case comprises four quarter circle shaped containers, each having a hollow cylinder at its small end which is placed over the cylinders in the four corners of said base, which enables the containers to pivot about the cylinders in the corners of the base;

said upper case is a rectangle case having a hole in the bottom of said case to receive said large hollow cylinder of said base, multiple separate plates in different height and shapes installed in its interior, and four hollow cylinders in its four corners, said hollow cylinders jointing with the top ends of said cylinders in said base, an exterior of the upper case including grooves in each side;

said cover is a lattice frame having hemispheric caps installed in the tope of four rounded corners which are received in the hollow cylinders of said lower case, said cover including triangular pieces installed in the frame to slide into the grooves of the upper case, and further including a hole installed in the center of the cover to receive the large hollow cylinder of said rotary base.

* * * * *